US006681736B2

(12) United States Patent
Sumimoto et al.

(10) Patent No.: US 6,681,736 B2
(45) Date of Patent: Jan. 27, 2004

(54) STARTER PROTECTIVE DEVICE

(75) Inventors: Katsuyuki Sumimoto, Tokyo (JP); Keiichi Komurasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 289 days.

(21) Appl. No.: 09/963,413

(22) Filed: Sep. 27, 2001

(65) Prior Publication Data

US 2002/0038643 A1 Apr. 4, 2002

(30) Foreign Application Priority Data

Oct. 2, 2000 (JP) ..... 2000-301922

(51) Int. Cl.[7] ..... F02N 11/08; F02N 17/00

(52) U.S. Cl. ..... 123/179.3; 290/38 R; 123/179.25; 123/179.28; 123/179.12

(58) Field of Search ..... 123/179.3, 179.25, 123/179.28, 179.29, 179.14, 179.12, 179.24; 290/38 R

(56) References Cited

U.S. PATENT DOCUMENTS 4,930,466 A * 6/1990 Osborne, Jr. ..... 123/179.5
5,383,428 A * 1/1995 Fasola et al. ..... 123/179.3
5,564,375 A * 10/1996 Orzal ..... 123/179.3
5,622,148 A * 4/1997 Xue et al. ..... 123/179.25
5,983,850 A 11/1999 Vilou ..... 123/179.3
6,050,233 A * 4/2000 Vilou ..... 123/179.3
6,148,781 A * 11/2000 Boegner et al. ..... 123/179.3
6,531,787 B2 * 3/2003 Koelle et al. ..... 290/31

FOREIGN PATENT DOCUMENTS

| | | |
|---|---|---|
| DE | 39 00 780 C2 | 8/1989 |
| DE | 195 03 537 A1 | 8/1996 |
| DE | 197 22 916 A1 | 12/1998 |
| EP | 0 848 160 B1 | 6/1998 |
| JP | 60 175 765 A | 9/1985 |
| JP | 10-184503 | 7/1998 |

* cited by examiner

*Primary Examiner*—Hieu T. Vo
*Assistant Examiner*—Johnny H. Hoang
(74) *Attorney, Agent, or Firm*—Sughrue Mion, PLLC

(57) ABSTRACT

A starter protective device is provided which is capable of accurately determining the commencement of overrunning (i.e., timing of the commencement of starting of an engine) even in the presence of variations in the cycle of fluctuations in a battery voltage, noise and so on, thereby to prevent a starter from being overrun after starting of an engine in a reliable manner. The starter protective device includes an overrunning determination section 15 for determining when the starter motor 4 commences overrunning; and a starter motor cut-off section for interrupting the main contactor 3 when it is determined that the starter motor 4 commences overrunning. The overrunning determination section 15 detects a change over time of the battery voltage BV after the starter switch 2 has been turned on, and determines that the starter motor 4 commences overrunning when the battery voltage VB remains unchanged without any increase or decrease over a predetermined time T.

7 Claims, 3 Drawing Sheets

STARTER PROTECTIVE DEVICE

This application is based on Application No.2000-301922, filed in Japan on Oct. 2, 2000, the contents of which are hereby incorporated by reference.

BACKGROUND OF THE INVENTION

1. Field of the Invention

The present invention relates to a protective device for a vehicle starter used during cranking, and in particular, to a starter protective device which is capable of accurately determining an overrunning state of a starter motor even in the presence of noise and/or variations in the cycle of fluctuations in a battery voltage during an engine is being cranked, thereby to prevent damage to the starter motor due to unnecessary overrunning thereof after the engine has been started.

2. Description of the Related Art

In general, when a motor vehicle engine is started, the driver hears the sound generated by the engine at the same time when he or she turns on a starter switch, and upon sensing a characteristic sound generated at the commencement of engine starting, the driver turns off the starter switch.

Since the engine generation sound is becoming more and more quiet along with the improved performance of engines in recent years, however, there are many cases in which it is quite difficult for the driver to accurately sense or discriminate the engine generation sound from other sounds or noise originated from a variety of sound sources.

Moreover, for large-scale vehicles such as trucks in which the distance from the driver's seat to the engine is long, it is extremely difficult for the driver seating in his or her seat in a passenger compartment to catch the sound generated by the engine installed in an engine room remote from the driver's seat, as a consequence of which it becomes difficult for the driver to promptly turn off the starter switch as soon as the engine has been started, so as to avoid the overrunning state of the starter motor.

In order to prevent the motor damage or the like due to such an overrunning of the starter motor (i.e., the state in which the starter continues operating though the engine has begun to operate autonomously), there have been proposed a variety of starter protective devices.

In case of a conventional starter protective device disclosed in Japanese Patent Application Laid-Open No. 10-184503 for example, timing of the commencement of starting of an engine is automatically detected from the cycle of fluctuations in the battery voltage waveform during cranking, whereby the starter motor is turned off at that timing.

That is, during engine starting, after the battery voltage first decreases rapidly, the load on the starter motor is periodically increased at angle positions corresponding to the compression strokes of engine cylinders, so there is obtained a waveform of cyclic fluctuations in the battery voltage during cranking.

Thereafter, when the engine commences starting, the load on the starter motor decreases suddenly and an alternator comes to perform power generation, so that the cycle of the waveform of fluctuations in the battery voltage becomes long, and at the same time the battery voltage is rising.

Thus, the cycle of the waveform of fluctuations in the battery voltage is measured, and when it reaches a predetermined value or above, a determination is made as to whether the starter motor commences to be overrun, and if so, the starter motor can be turned off.

That is, based on the fluctuations in the battery voltage generated by the power supply from the battery to the starter at the time of engine starting, it is detected whether the engine has entered an autonomously operating state, and it is possible to compulsorily interrupt the operation of the starter at the instant when the engine has begun autonomous operation.

As a result, it is possible to prevent the internal component parts (e.g., starter motor, etc.) of the starter from being damaged, which would otherwise result from starter's excessive overrunning.

However, the waveform of fluctuations in the battery voltage during cranking varies greatly, for example, the cycle of fluctuations is increased owing to a cold engine state upon starting of the engine, and in addition to this, the results of determinations on the cycle of fluctuations also become different under the influence of noise superposition. Therefore, the reliability in the determination of overrunning according to the above-mentioned conventional device is low and hence it is difficult for the conventional device to provide a satisfactory starter protective function.

As can be seen from the foregoing, the conventional starter protective device has a problem that the commencement of overrunning can not be determined accurately thanks to the influences of the engine condition, noise and so on at the time of engine starting, thus making it impossible to achieve a satisfactory protective function for starters.

SUMMARY OF THE INVENTION

The present invention is intended to obviate the problems as referred to above, and has for its object to provide a starter protective device which is capable of accurately determining the commencement of overrunning (i.e., timing of the commencement of starting of an engine) even in the presence of variations in the cycle of fluctuations in the battery voltage, noise and so on, thereby to prevent a starter from being overrun after starting of an engine in a reliable manner.

Bearing the above object in mind, the present invention resides in a starter protective device comprising an electronic control unit supplied with a battery voltage from a battery mounted on a vehicle, a starter switch connected with an output terminal of the battery, a main contactor adapted to be driven under the control of the electronic control unit in response to the starter switch being turned on, and a starter motor adapted to be driven to operate by the battery voltage supplied thereto from the battery through the main contactor when the main contactor is turned on or closed. The electronic control unit includes an overrunning determination section for determining when the starter motor commences overrunning, and a starter motor cut-off section for interrupting or opening the main contactor when it is determined that the starter motor commences overrunning. The overrunning determination section detects a change over time of the battery voltage after the starter switch has been turned on, and determines that the starter motor commences overrunning when the battery voltage remains unchanged without any increase or decrease over a predetermined time.

In a preferred form of the present invention, the overrunning determination section includes a storage section for storing a waveform value of fluctuations in the battery voltage in time steps, a comparison unit for sequentially comparing a current voltage value of the battery voltage and a plurality of past voltage values thereof stored in the storage section according to the time steps, and a determination signal generating section for generating an overrunning determination signal indicative of the commencement of overrunning of the starter motor when comparison results of the comparison unit exhibit the same results over the predetermined time.

In another preferred form of the present invention, the storage section stores the waveform values of fluctuations in the battery voltage in a plurality of mutually different time steps. The comparison unit includes a plurality of comparison sections for individually comparing the current voltage value and the plurality of past voltage values stored in the storage section. The overrunning determination section includes a logical arithmetic operation section for logically summing the respective comparison results of the comparison sections. The determination signal generating section generates the overrunning determination signal when an output level of the logical arithmetic operation section remains the same over the predetermined time.

In a further preferred form of the present invention, the storage section stores, as the plurality of past voltage values, at least two voltage values at previous time points 10 ms and 20 ms, respectively, before the current time.

In a yet further preferred form of the present invention, the predetermined time is initially set to 500 ms.

In a still further preferred form of the present invention, the overrunning determination section includes a predetermined time calculation section for calculating the predetermined time, and the predetermined time calculation section variably sets the predetermined time based on a past record value of a transition cycle of the comparison results of the comparison unit.

In a further preferred form of the present invention, the predetermined time is set to 1.5 to 2 times the past record value of the transition cycle of the comparison results.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENT

Now, a preferred embodiment of the present invention will be described in detail while referring to the accompanying drawings. Embodiment 1.

Figure 1:
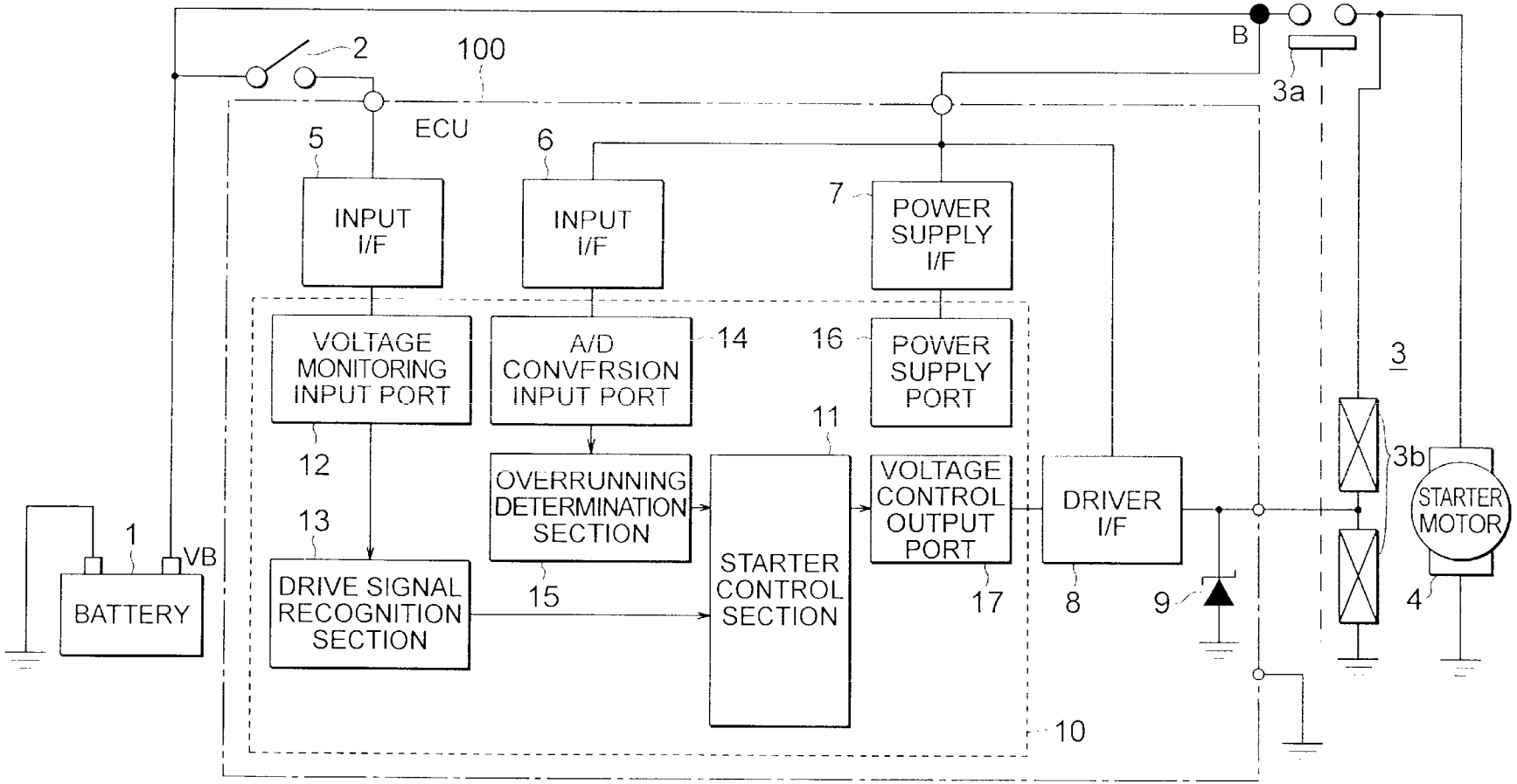
FIG. 1 is a circuit block diagram schematically illustrating the overall construction of a starter protective device according to one embodiment of the present invention.

FIG. 1 schematically illustrates the overall construction of a starter protective device according to one embodiment of the present invention.

Figure 2:
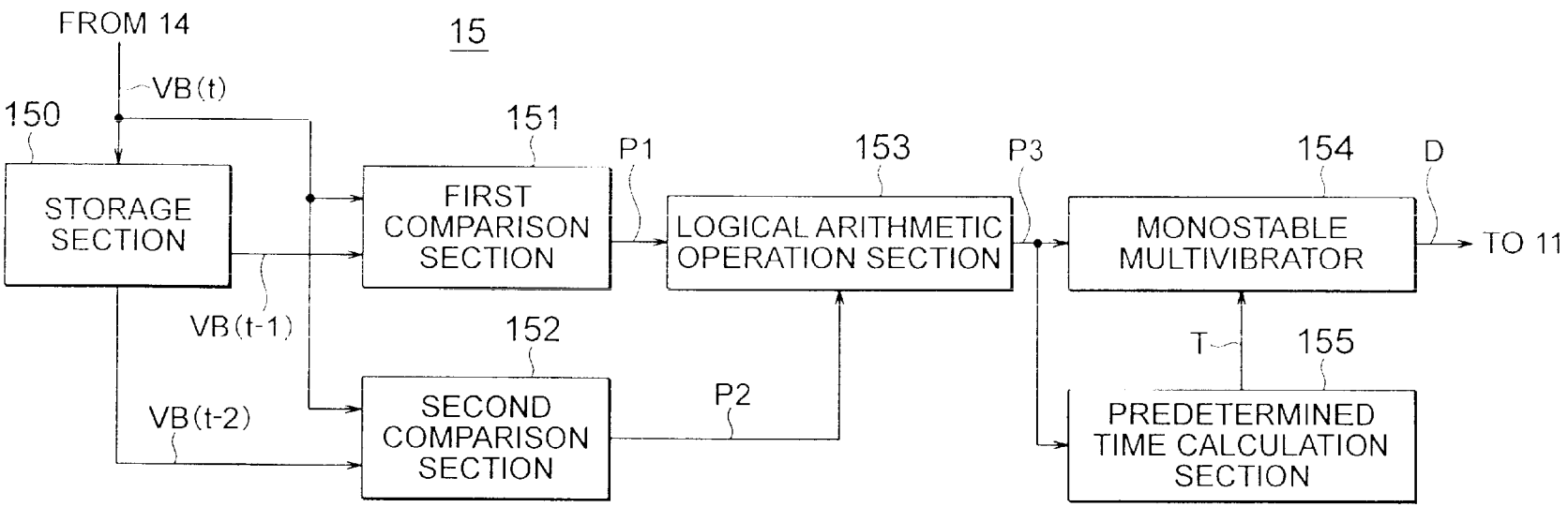
FIG. 2 is a functional block diagram illustrating the concrete construction of an overrunning determination section according to the embodiment of the present invention.

FIG. 2 illustrates the concrete configuration of an overrunning determination section in FIG. 1.

Figure 3:
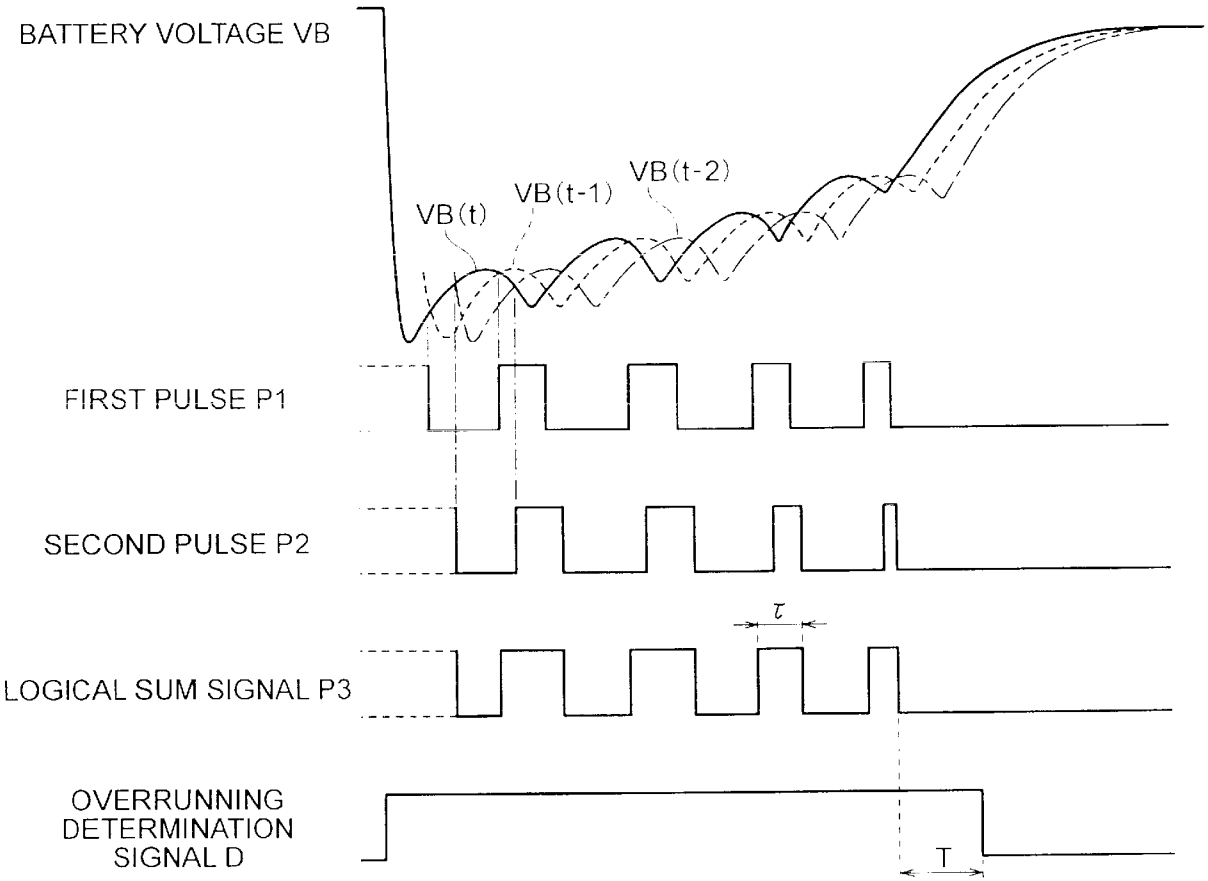
FIG. 3 is a timing chart illustrating the operation of the overrunning determination section according to the embodiment of the present invention.

FIG. 3 illustrates the operation of the overrunning determination section in FIG. 1.

In FIG. 1, the starter protective device includes a battery 1 mounted on a vehicle, an electronic control unit (hereinafter simply referred to as ECU) 100 to which a battery voltage VB from the battery 1 is supplied, and a starter switch 2 connected with an output terminal (i.e., a starter' B terminal) of the battery 1.

The ECU 100 can be arranged at a location adjacent or remote from a vehicle starter.

A main contactor 3 in the form of a solenoid is driven to operate under the control of the ECU 100 in response to the starter switch 2 being turned on.

As shown in FIG. 1, the main contactor 3 is constituted by a contact 3*a* for selectively opening and closing a connection between the battery 1 and a starter motor 4, and two solenoid coils 3*b* for opening and closing the contact 3*a*.

The starter motor 4 for starting an engine is supplied with the battery voltage VB of the battery 1 upon closure of the main contactor 3.

The ECU 100 controls the power supply to the main contactor 3, and the main contactor 3 controls the power supply to the starter motor 4.

The main contactor 3 is provided integrally with a starter pinion gear (not shown) for selectively connecting the starter motor 4 with an output shaft of the engine. Upon closure of the main contactor 3, it acts to connect the starter pinion gear with the engine output shaft.

The ECU 100 includes input interfaces 5 and 6, a power supply interface 7, a driver interface 8, a Zener diode 9 inserted between an output terminal of the driver interface 8 and ground, and a microcomputer 10.

The input interface 5 serves to input the battery voltage VB through the starter switch 2 to the microcomputer 10 as a start signal.

The input interface 6 includes a filter circuit with a condenser (not shown) for removing electrical noise, and always inputs the battery voltage VB, the waveform of which is to be monitored, to the microcomputer 10.

The power supply interface 7 generates a power supply voltage (e.g., 3V) for the microcomputer 10 from the battery voltage VB of the battery 1, and always supplies it to the microcomputer 10.

The driver interface 8 includes a semiconductor switch, and acts to output a starter control signal from the microcomputer 10 to a connection point between the solenoid coils 3*b*.

The input interfaces 5, 6, power supply interface 7, driver interface 8, Zener diode 9 and microcomputer 10 together constitute the ECU 100 which functions as a starter protective circuit.

The ECU 100 is electrically connected with a positive terminal of the battery 1 through the starter switch 2, the output terminal (starter's B terminal) of the battery 1, a connection point between the solenoid coils 3*b* of the main contactor 3, and ground, respectively.

The microcomputer 10 includes a starter control section 11, a voltage monitoring input port 12, a drive signal recognition section 13, an A/D conversion input port 14, an overrunning determination section 15, a power supply input port 16, and a voltage control output port 17.

The starter control section 11 controls the power supply to the starter motor 4 through the main contactor 3, and the position of the unillustrated starter pinion gear.

The voltage monitoring input port 12 monitors an input voltage (i.e., a start signal) from the input interface 5.

The drive signal recognition section 13 recognizes the start signal thus input thereto through the voltage monitoring input port 12 as a drive signal of the main contactor 3, and sends it to the starter control section 11.

The A/D conversion input port 14 converts the battery voltage VB from the input interface 6 into a digital signal and then supplies it to the overrunning determination section 15.

The overrunning determination section 15 determines based on the waveform of the digitized battery voltage VB whether or not the starter motor 4 has commenced to be overrun. When a positive determination is made, the overrunning determination section 15 generates an overrunning determination signal D and supplies it to the starter control section 11.

That is, the overrunning determination section 15 detects a change over time of the battery voltage VB after the starter switch 2 has been turned on, and when the battery voltage VB does not change to increase or decrease over a predetermined period of time, the commencement of overrunning of the starter motor 4 is determined.

The starter control section 11 includes a starter motor cut-off section for interrupting the main contactor 3 in response to the overrunning determination signal D when the commencement of overrunning of the starter motor 4 is determined.

The power supply input port 16 takes in the battery voltage VB from the power supply interface 7 as a power supply for the microcomputer 10.

The voltage control output port 17 is inserted between the starter control section 11 and the driver interface 8 for controlling an output voltage supplied to the main contactor 3.

In FIG. 2, the overrunning determination section 15 includes a storage section 150 connected to receive the output signal of the A/D conversion input port 14 for storing the values of the waveform of fluctuations in the battery voltage VB in time steps, a comparison unit comprised of a first comparison section 151 and a second comparison section 151 respectively connected to receive the output signal of the A/D conversion input port 14 and connected with the storage section 150, a logical arithmetic calculation section 153 for performing a logical sum of a first pulse P1 output from the first comparison section 151 and a second pulse P2 output from the second comparison section 152 (i.e., a sum of respective comparison results of the first and second comparison sections 151, 152) to generate an output signal in the form of a logical sum pulse P3, a monostable multivibrator 154 for generating an overrunning determination signal D based on the logical sum pulse P3, and a predetermined time calculating section 155 for calculating a predetermined time T based on the logical sum pulse P3.

The storage section 150 stores the fluctuation waveform values VB(t) of the battery voltage VB in a plurality of mutually different time steps (t−1), (t−2), . . . .

For instance, the storage section 150 stores at least two preceding voltage values at time points 10 ms and 20 ms, respectively, before the current time as a plurality of (e.g., two in this case) past voltage values VB(t−1) and VB(t−2).

Here, it is to be noted that preferred previous time points (e.g., 10 ms and 20 ms before) for the past voltage values VB(t−1) and VB(t−2) are set, for example, to be equal to or less than ½ of the rotation cycle of the engine during cranking.

The first comparison section 151 and the second comparison section 152 compare the current voltage value VB(t) of the battery voltage VB with the plurality of past voltage values VB(t−1) and VB(t−2) stored in the storage section 150 sequentially and individually in order of the time steps.

The monostable multivibrator 154 constitutes a determination signal generating section, and generates an overrunning determination signal D indicative of the commencement of overrunning of the starter motor 4 when the logical sum pulse P3 (i.e., the output level of the logical arithmetic operation section 153) of the respective comparison results (i.e., the first pulse P1 and the second pulse P2) of the first and second comparison sections 151 and 152 exhibits the same results for a predetermined period of time.

The predetermined time calculation section 155 always measures a transition cycle $\tau$ of the logical sum pulse P3, variably sets a predetermined time T suitable for the determination of overrunning based on a past record value $\tau$ of the transition cycle, and drives the monostable multivibrator 154 to operate for the predetermined time T after the predetermined time T has been variably set.

For instance, the predetermined time T is initially set to 500 ms as shown in FIG. 3.

In addition, the predetermined time T is variably set based on the comparison results of the respective comparison sections 151, 152 or the past record value $\tau$ of the transition cycle of the logical sum pulse P3.

At this time, it is preferable that the predetermined time T be set to about 1.5 or 2 times the past record value $\tau$ of the transition cycle in order to avoid an incorrect determination of the commencement of overrunning of the starter motor 4.

Next, reference will be made to the concrete operation of this embodiment of the present invention while referring to the timing chart of FIG. 3 along with FIG. 1 and FIG. 2.

First of all, in order to start the engine, the starter switch 2 is turned on by a manipulation of the driver or under the control of an external unit.

The state of the starter switch 2 being turned on is recognized by the drive signal recognition section 13 in the microcomputer 10 of the ECU 100. The starter control section 11 determines, based on the recognition result of the drive signal recognition section 13 and the determination result of the overrunning determination section 15, whether or not the starter is to be energized.

At this time, since the overrunning determination section 15 does not output an overrunning determination signal D at the beginning of engine cranking, the starter control section 11 makes a determination that the starter can be operated or energized, and executes voltage application control so as to put the driver interface 8 into driving operation.

Then, the starter control section 11 in the microcomputer 10 drives the driver interface 8 through the voltage control output port 17.

As a result, the power supply to the two solenoid coils 3*b* of the main contactor 3 is commenced so that the main contactor 3 is turned on to start supplying electric power to the starter motor 4 thereby to initiate engine cranking.

During the cranking of the engine, cyclic variations or fluctuations VB(t) of the battery voltage VB, as represented by a solid line waveform in FIG. 3, are developed at the starter' B terminal (i.e., an input terminal from the battery 1) in accordance with intermittent compression strokes of the engine as described above.

At this time, the overrunning determination section 15 of the ECU 100 connected with the starter' B terminal monitors the battery voltage fluctuations VB(t) through the input interface 6 and the A/D conversion input port 14.

In addition, the storage section 150 in the overrunning determination section 15 stores a plurality of voltage fluctuations VB(t−1) and VB(t−2) at predetermined previous times (for instance, 10 ms and 20 ms before) in time steps, as represented by waveforms of a broken line and an alternate long and short dash line, respectively, in FIG. 3.

Here, note that the first comparison section 151 makes a comparison between the latest voltage value VB(t) and a previous voltage value VB(t−1) at 10 ms before, and generates a first pulse P1, which becomes a high (H) level when a relation VB(t)<VB(t−1) is satisfied.

Also, the second comparison section 152 makes a comparison between the latest voltage value VB(t) and a voltage value VB(t−2) at 20 ms before, and generates a second pulse P2, which becomes a high (H) level when a relation VB(t) <VB(t−2) is satisfied.

Moreover, the logical arithmetic operation section 153 takes a logical sum of the comparison results comprising the first pulse P1 and the second pulse P2, and generates a logical sum pulse P3 as shown in FIG. 3.

The logical sum pulse P3 is input to the monostable multivibrator 154, so that the output of the monostable multivibrator 154 is held high only for the predetermined time T each time the logical sum pulse P3 becomes a logical high level.

In other words, if the logical sum pulse P3 becomes high again within the predetermined time T, the output level of the monostable multivibrator 154 remains high as illustrated in FIG. 3, and hence an overrunning determination signal D (i.e., a low level) is not generated.

That is, if the logic "0 or 1" of the logical sum pulse P3 reverses within a period of 500 ms (initial value), the overrunning determination section 15 determines that the starter motor 4 is not in the state of commencing overrunning.

Moreover, if the logic "0 or 1" of the logical sum pulse P3 does not reverse over 500 ms or more (initial value) (i.e., if the same logic continues), the output level of the monostable multivibrator 154 becomes low, and hence the overrunning determination section 15 generates an overrunning determination signal D (i.e., a low level) indicative of the fact that the starter motor 4 is in the state of commencing overrunning".

On the other hand, the logical sum pulse P3 is input to the predetermined time calculation section 155 where the reversing cycle τ of the logic "0 or 1" is measured.

The predetermined time calculation section 155 sets the predetermined time T to 1.5 to 2 times the latest (minimum) value of the past record value τ of the transition cycle in the logical level of the logical sum pulse P3.

For instance, in case where the predetermined time T is variably set to twice the transition cycle τ, the predetermined time T becomes 200 ms if the transition cycle τ is 100 ms.

As a result, the operation cycle of the monostable multivibrator 154 is updated to the changed predetermined time T thus set.

When the overrunning determination signal D is output from the overrunning determination section 15, the starter control section 11 detects that the starter motor 4 is in the state of commencing overrunning, and interrupts the driving of the driver interface 8 to turn off the main contactor 3, thereby stopping the starter motor 4 and at the same time disengaging the starter pinion gear from the engine output shaft.

In this manner, the ECU 100, which controls the vehicle starter, stores the waveform of fluctuations in the battery voltage VB (i.e., the voltage of the starter' B terminal) occurring during cranking in time steps, and makes comparisons between the current voltage value VB(t) and the past voltage values VB(t−1) and VB(t−2), so that it can stop the operation of the starter motor 4, thus avoiding its overrunning when it is determined that these comparison results remain the same over the predetermined time T.

At this time, at least the two voltage values VB(t−1) and VB(t−2), which are different in time from each other, are used as the past voltage values to be compared with the current voltage value VB(t). Since the logical sum pulse P3 of the first pulse P1 and the second pulse P2 has redundancy, there is little likelihood of incorrectly determining the commencement of overrunning of the starter motor 4.

For instance, even in the event that either one of the first pulse P1 and the second pulse P2 remains at a low level due to the influence of noise or the like at a time point prior to the time the starter motor 4 comes to overrunning, if the other repeatedly takes a high level, there is no possibility of an overrunning determination signal D being output.

In addition, by setting at least two past voltage values VB(t−1) and VB(t−2) at time points 10 ms and 20 ms, respectively, before the current time, it is possible to make a reliable comparison between shifted waveforms at two different points, as shown in FIG. 3, within a sufficiently small range with respect to the usual cycle of fluctuations in the battery voltage VB during cranking.

Moreover, by initially setting the predetermined time T to a sufficiently long period of 500 ms, it is possible to avoid a likelihood of erroneously outputting an overrunning determination signal D in a reliable manner in the initial state in which the cycle of fluctuations in the battery voltage VB is unknown.

Further, since the predetermined time T is updated to an optimum value (e.g., 1.5 to 2 times) based on the transition cycle τ (past record value) of the comparison results after the cycle of fluctuations in the battery voltage VB has been detected, an overrunning determination signal D can be promptly output according to the transition cycle τ.

Accordingly, even in the presence of a variety of variation factors related to the battery voltage VB, noises and so on, it is possible to promptly and positively prevent unnecessary overrunning of the starter motor 4 after starting of the engine. This serves to reduce troubles or failures resulting from overrunning to a substantial extent.

Moreover, since the commencement of autonomous operation of the engine can be detected by using only the cycle of fluctuations in the battery voltage VB without using a pulse representative of the number of revolutions per unit time of the engine existing in the vehicle, the present invention can be easily applied to other usage, for instance, it can be retrofitted to an existing remote control starter, and hence its efficacy and usefulness are extremely high.

It is to be noted that the logical sum pulse P3 of the first pulse P1 and the second pulse P2 based on the past two voltage values VB(t−1) and VB(t−2) has been used herein in order to prevent an incorrect determination of overrunning in a reliable manner, but there may be employed a logical sum pulse based on past three or more voltage values.

Although the voltage values at previous time points 10 ms and 20 ms, respectively, before the current time have been used as the past voltage values, voltage values at other previous time points may be employed as necessary.

In addition, although the transition cycle of the logical sum pulse P3 has been measured so as to variably set the predetermined time T, at least one of the transition cycles of the first pulse P1 and the second pulse P2 may be measured to the same purpose.

Moreover, although the determination of overrunning has been made based on the transition cycle of the logical sum pulse P3, it may be done based on either the transition cycle of the first pulse P1 or that of the second pulse P2.

Further, although the predetermined time T has been set to 1.5 to 2 times the past record value $\tau$ of the transition cycle so as to achieve a prompt determination of overrunning, the predetermined time T may be set to more than twice the transition cycle, thus giving priority to the prevention of an incorrect determination of overrunning.

Still further, although the predetermined time T has been variably set based on the transition cycle corresponding to the cycle of fluctuations in the battery voltage VB, the predetermined time T may not be updated but fixed to the initial value (e.g., 500 ms) without any change.

While the invention has been described in terms of a preferred embodiment, those skilled in the art will recognize that the invention can be practiced with modifications within the spirit and scope of the appended claims.

What is claimed is:

1. A starter protective device comprising:

an electronic control unit supplied with a battery voltage from a battery mounted on a vehicle;

a starter switch connected with an output terminal of said battery;

a main contactor adapted to be driven under the control of said electronic control unit in response to said starter switch being turned on; and a starter motor adapted to be driven to operate by said battery voltage supplied thereto from said battery through said main contactor when said main contactor is turned on;

said electronic control unit including:

an overrunning determination section for determining when said starter motor commences overrunning; and a starter motor cut-off section for interrupting said main contactor when it is determined that said starter motor commences overrunning;

wherein said overrunning determination section detects a change over time of said battery voltage after said starter switch has been turned on, and determines that said starter motor commences overrunning when said battery voltage remains unchanged without any increase or decrease over a predetermined time.

2. The starter protective device according to claim 1, wherein said overrunning determination section comprises:

a storage section for storing a waveform value of fluctuations in said battery voltage in time steps;

a comparison unit for sequentially comparing a current voltage value of said battery voltage and a plurality of past voltage values thereof stored in said storage section according to said time steps; and a determination signal generating section for generating an overrunning determination signal indicative of the commencement of overrunning of said starter motor when comparison results of said comparison unit exhibit the same results over said predetermined time.

3. The starter protective device according to claim 2, wherein said storage section stores said waveform values of fluctuations in said battery voltage in a plurality of mutually different time steps, and said comparison unit includes a plurality of comparison sections for individually comparing said current voltage value and said plurality of past voltage values stored in said storage section, and said overrunning determination section includes a logical arithmetic operation section for logically summing the respective comparison results of said comparison sections, and said determination signal generating section generates said overrunning determination signal when an output level of said logical arithmetic operation section remains the same over said predetermined time.

4. The starter protective device according to claim 3, wherein said storage section stores, as said plurality of past voltage values, at least two voltage values at previous time points 10 ms and 20 ms, respectively, before the current time.

5. The starter protective device according to claim 2, wherein said overrunning determination section includes a predetermined time calculation section for calculating said predetermined time, and said predetermined time calculation section variably sets said predetermined time based on a past record value of a transition cycle of the comparison results of said comparison unit.

6. The starter protective device according to claim 5, wherein said predetermined time is set to 1.5 to 2 times the past record value of the transition cycle of said comparison results.

7. The starter protective device according to claim 1, wherein said predetermined time is initially set to 500 ms.

* * * * *